US010378424B2

(12) United States Patent
Okamura et al.

(10) Patent No.: US 10,378,424 B2
(45) Date of Patent: Aug. 13, 2019

(54) EXHAUST GAS RECIRCULATION SYSTEM

(71) Applicant: DENSO CORPORATION, Kariya, Aichi-pref. (JP)

(72) Inventors: Toru Okamura, Kariya (JP); Kenichi Nara, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/905,942

(22) Filed: Feb. 27, 2018

(65) Prior Publication Data

US 2018/0252145 A1 Sep. 6, 2018

(30) Foreign Application Priority Data

Mar. 6, 2017 (JP) ..... 2017-42061

(51) Int. Cl.

| | |
|---|---|
| ***F01P 7/16*** | (2006.01) |
| ***F02M 26/32*** | (2016.01) |
| ***F01P 11/04*** | (2006.01) |
| ***F01P 11/16*** | (2006.01) |
| *F01P 7/14* | (2006.01) |

(52) U.S. Cl.

CPC ..... *F01P 7/16* (2013.01); *F01P 11/04* (2013.01); *F01P 11/16* (2013.01); *F02M 26/32* (2016.02); *F01P 2007/146* (2013.01); *F01P 2060/16* (2013.01)

(58) Field of Classification Search

CPC . F01P 3/12; F01P 1/06; F01P 2060/12; F02M 26/28; F02M 26/33; F02M 2026/004; F02M 25/0222; F02M 35/10268

See application file for complete search history.

(56) References Cited

U.S. PATENT DOCUMENTS

| | | | | |
|---|---|---|---|---|
| 7,461,641 | B1 * | 12/2008 | Styles | F02M 26/19 123/568.12 |
| 2007/0157893 | A1 * | 7/2007 | Wei | F01P 3/02 123/41.08 |
| 2009/0235662 | A1 * | 9/2009 | Knafl | F02M 26/25 60/600 |
| 2011/0232301 | A1 * | 9/2011 | He | F02D 41/005 62/3.2 |
| 2011/0232304 | A1 * | 9/2011 | Bortoletto | F25D 17/042 62/78 |

(Continued)

FOREIGN PATENT DOCUMENTS

| | | | |
|---|---|---|---|
| JP | 06185382 A | * | 7/1994 |
| JP | 06185382 A | * | 7/1994 |

(Continued)

*Primary Examiner* — Long T Tran

(74) *Attorney, Agent, or Firm* — Harness, Dickey & Pierce, P.L.C.

(57) ABSTRACT

The exhaust gas recirculation system comprises an exhaust recirculation pipe configured to recirculate an exhaust gas from an engine into an intake pipe of the engine, an exhaust gas heat exchanger connected to the exhaust recirculation pipe and configured to perform an heat exchange between the exhaust gas and an engine cooling water used for cooling the engine, a cooling water pipe configured to circulate the engine cooling water to the exhaust gas heat exchanger, and a heat insulating member forming a heat insulating layer on a heat transfer path from the exhaust gas heat exchanger to the outside.

10 Claims, 5 Drawing Sheets

(56) References Cited

U.S. PATENT DOCUMENTS

| | | | | |
|---|---|---|---|---|
| 2012/0048245 | A1* | 3/2012 | Knafl | F02D 41/0077 123/568.12 |
| 2012/0160447 | A1* | 6/2012 | Kinomura | B60H 1/025 165/51 |
| 2013/0061584 | A1* | 3/2013 | Gerges | F01N 5/02 60/320 |
| 2014/0034028 | A1* | 2/2014 | Zhang | F28F 9/02 123/568.12 |
| 2014/0096685 | A1* | 4/2014 | Backhaus-Ricoult | F01N 3/2882 96/420 |
| 2014/0345579 | A1* | 11/2014 | Keppy | F02M 26/30 123/568.12 |
| 2015/0136048 | A1* | 5/2015 | Sundemo | F01P 7/16 123/41.1 |
| 2017/0058754 | A1* | 3/2017 | Hebert | F02B 37/22 |
| 2017/0335805 | A1* | 11/2017 | Zhang | F01P 3/20 |

FOREIGN PATENT DOCUMENTS

| | | | |
|---|---|---|---|
| JP | H11-125151 | A | 5/1999 |
| JP | 2001-073754 | A | 3/2001 |

* cited by examiner

EXHAUST GAS RECIRCULATION SYSTEM

CROSS REFERENCE TO RELATED APPLICATION

This application is based on Japanese Patent Application No. 2017-42061 filed on Mar. 6, 2017, the disclosure of which is incorporated herein by reference.

FIELD

The present disclosure relates to an exhaust gas recirculation system that recirculates a part of an exhaust gas exhausted from an engine to an intake side of the engine.

BACKGROUND

Japanese Patent publication No. 11-125151 (referred to as patent document 1, hereinafter) shows the exhaust gas recirculation system (referred to as EGR system) which recirculates a part of an exhaust gas (referred to as EGR gas) exhausted from an engine to an intake side of the engine. In the exhaust gas recirculation system, it is required to control the EGR gas to an appropriate temperature, when the EGR gas is recirculated to the intake side. The exhaust gas recirculation system preforms a heat exchange between an engine cooling water and the EGR gas in an EGR cooler. When the temperature of the engine cooling water is low, the temperature of the engine cooling water is heated above the dew point temperature of the EGR gas by a combustion heater. Accordingly, a generation of sulfuric acid caused by gaseous components dissolving into dew condensed EGR gas can be suppressed. The exhaust gas recirculation can be carried out before a warming-up of the engine is completed, and the effect of reducing nitrogen oxides can be obtained at an early stage.

SUMMARY

In the conventional exhaust gas recirculation system, the combustion heater is used for heating the engine cooling water. A large amount of fuel is necessary for heating the engine cooling water, and there is a problem that fuel consumption deteriorates.

The exhaust gas recirculation system in the present disclosure comprises an exhaust recirculation pipe configured to recirculate an exhaust gas from the engine into an intake pipe of the engine, an exhaust gas heat exchanger connected to the exhaust recirculation pipe and configured to perform an heat exchange between the exhaust gas and an engine cooling water used for cooling the engine, a cooling water pipe configured to circulate the engine cooling water to the exhaust gas heat exchanger, and a heat insulating member forming a heat insulating layer on a heat transfer path from the exhaust gas heat exchanger to the outside.

DETAILED DESCRIPTION

Figure 1:
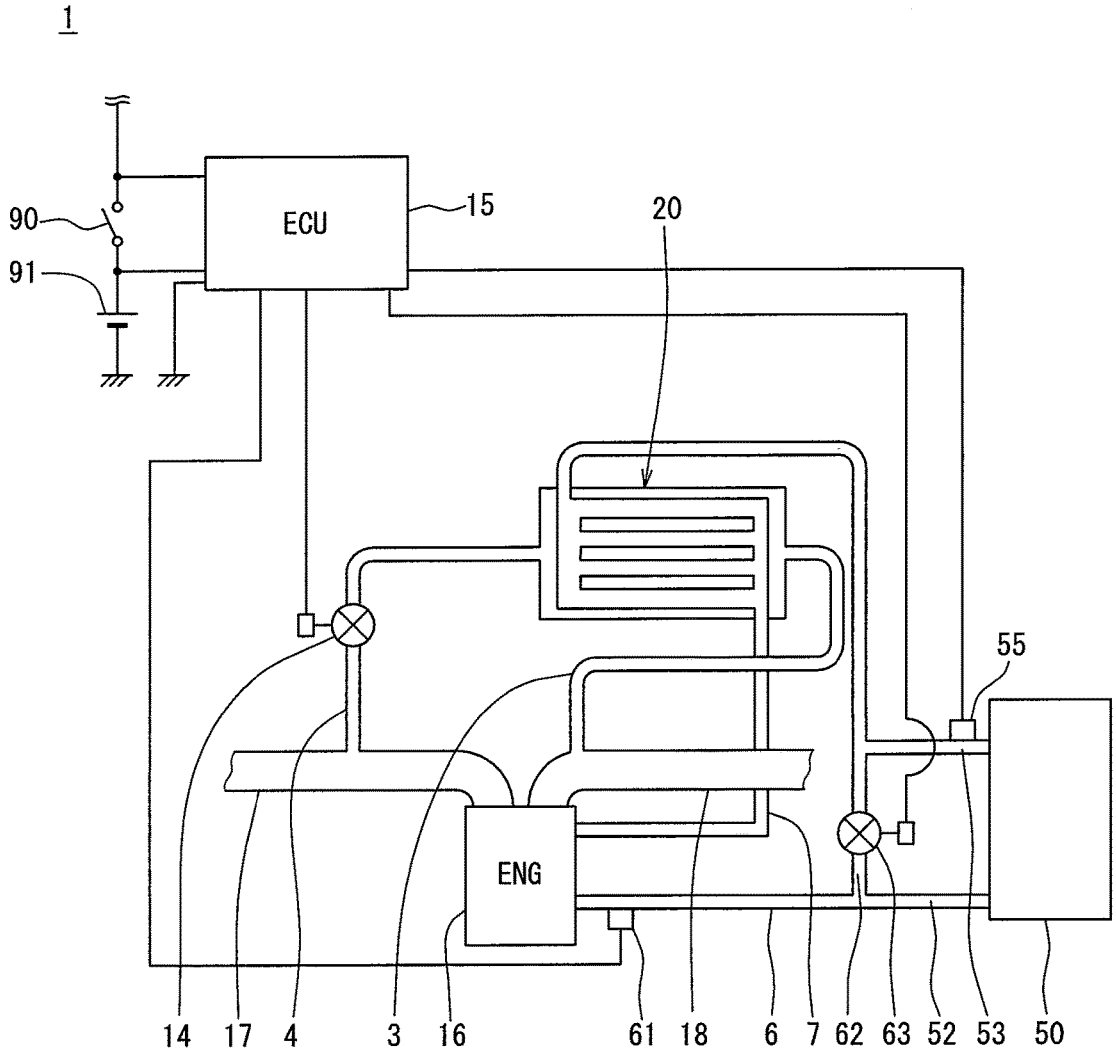
FIG. 1 is a diagram illustrating a block chart showing an exhaust gas recirculation system.

In the following, embodiments of the present disclosure are described with reference to the accompanying drawings. In the description and in the drawings, identical or similar components bear the same reference numerals or characters. If a part of the features in each embodiment is explained, the remaining part of the features may apply to the remaining part of the features in other embodiments.

First Embodiment

In FIG. 1, the exhaust gas recirculation system 1 has an engine (ENG) 16, an exhaust gas heat exchanger 20, a heat storage device 50, and plural pipes connecting them. The exhaust gas recirculation system 1 is mounted on a vehicle. The exhaust gas recirculation system 1 returns a part of the exhaust gas to an intake side of the engine 16 as an EGR gas so that the exhaust gas is recirculated.

The engine 16 has an intake pipe 17 and an exhaust pipe 18. The exhaust pipe 18 includes a first EGR pipe 3 constituting a part of an exhaust gas recirculation pipe. The intake pipe 17 includes a second EGR pipe 4 constituting a part of the exhaust gas recirculation pipe. The first EGR pipe 3 communicates with the second EGR pipe 4 via the exhaust gas heat exchanger 20. In other words, the exhaust gas heat exchanger 20 includes the first EGR pipe 3 for introducing the EGR gas into an inside of the exhaust gas heat exchanger 20. The exhaust gas heat exchanger 20 includes the second EGR pipe 4 for discharging the EGR gas from the inside of the exhaust gas heat exchanger 20 to the outside.

An EGR valve 14 is provided on the second EGR pipe 4. The EGR valve 14 is a regulate valve for adjusting an exhaust gas flow rate introduced into the intake pipe 17 through the second EGR pipe 4. As the EGR valve 14, for example, a poppet valve driven by a stepping motor, a linear solenoid or the like as a power source can be available. The EGR valve 14 can be held at a fully closed position and at a fully opened position, and can be at any position from the fully closed position to the fully opened position. The EGR valve 14 can adjust continuously the exhaust gas flow rate introduced into the intake pipe 17 from 0 (zero) to a maximum flow rate.

The exhaust gas heat exchanger 20 has a cooling water outflow pipe 7 for flowing an engine cooling water (LLC) from the inside of the exhaust gas heat exchanger 20 to the outside thereof. The cooling water outflow pipe 7 is connected to the engine 16. The exhaust gas heat exchanger 20 has a cooling water introduction pipe 6 for introducing the engine cooling water into the inside of the exhaust gas heat exchanger 20. The cooling water introduction pipe 6 is connected to the engine 16. The cooling water introduction pipe 6 and the cooling water outflow pipe 7 constitute a cooling water pipe in which the engine cooling water flows. A temperature sensor 61 for the cooling water is equipped to the cooling water introduction pipe 6. The cooling water temperature sensor 61 is positioned close to the engine 16.

A heat storage device 50 as a heating device is equipped to the cooling water introduction pipe 6. The heat storage device 50 is located downstream of the cooling water temperature sensor 61. In other words, the heat storage device 50 is provided in the middle of a path between the cooling water temperature sensor 61 and the exhaust gas heat exchanger 20. The engine cooling water flowed out of the engine 16 flows toward the heat storage device 50, after the engine cooling water passes through the cooling water temperature sensor 61. The cooling water temperature sensor 61 is provided so as to measure the water temperature of the engine cooling water immediately after flowing out of the engine 16.

The cooling water introduction pipe 6 has a bypass pipe 62. The bypass pipe 62 connects between an inlet pipe 52 of the heat storage device 50 and an outlet pipe 53 thereof. The bypass pipe 62 constitutes a flow path not passing through the heat storage device 50. In other words, the cooling water introduction pipe 6 has two paths which are a flow path passing through the bypass pipe 62 and a flow path passing through the heat storage device 50.

The bypass pipe 62 has a valve 63. In the cooling water introduction pipe 6, the heat storage device 50 and the valve 63 are arranged in parallel. The valve 63 adjusts the flow rate by regulating a cross sectional area in the flow path at a predetermined position. As the valve 63, for example, a poppet valve driven by a stepping motor, a linear solenoid or the like as a power source can be available. The valve 63 can be held at a fully closed position and at a fully opened position, and can be at any position from the fully closed position to the fully opened position. The valve 63 can continuously adjust the exhaust flow rate introduced into the bypass pipe 62 from 0 (zero) to a maximum flow rate. A flow path resistance of the bypass pipe 62 is set to be smaller in comparison with that of the heat storage device 50. Since the flow path of the bypass pipe 62 is closed upon the closure of the valve 63, the engine cooling water flows in the heat storage device 50.

The heat storage device 50 has the inlet pipe 52. The inlet pipe 52 is communicated to the cooling water introduction pipe 6 so that the cooling water can be introduced into the heat storage device 50. The heat storage device 50 has the outlet pipe 53. The outlet pipe 53 is communicated to the cooling water introduction pipe 6 so that the cooling water can be flowed out from the heat storage device 50. The heat storage device 50 includes a heat storage temperature sensor 55 that measures the temperature of the heat storage device 50. The heat storage temperature sensor 55 is equipped to the outlet pipe 53. The heat storage temperature sensor 55 measures the temperature of the engine cooling water immediately after the heat exchange is performed by means of the heat storage device 50.

The exhaust gas recirculation system 1 introduces a part of the exhaust gas of the engine 16 as EGR gas into the intake pipe 17 so that a part of the exhaust gas flows into the cylinder of the engine 16. The EGR gas is introduced into the exhaust gas heat exchanger 20 through the first EGR pipe 3. The EGR gas introduced in the exhaust gas heat exchanger 20 flows inside of the exhaust gas heat exchanger 20. The EGR gas flowing inside of the exhaust gas heat exchanger 20 is returned to the intake pipe 17 through the second EGR pipe 4. The exhaust gas is recirculated to the engine 16.

The engine cooling water is introduced in the exhaust gas heat exchanger 20 through the cooling water introduction pipe 6. The engine cooling water introduced into the exhaust gas heat exchanger 20 flows in the interior of the exhaust gas heat exchanger 20. The engine cooling water flowing through the interior of the exhaust gas heat exchanger 20 is flowed out from the exhaust gas heat exchanger 20 through the cooling water outflow pipe 7. The exhaust gas heat exchanger 20 performs a heat exchange between the EGR gas and the engine cooling water.

The exhaust gas heat exchanger 20 performs the heat exchange for the purpose of heating the EGR gas. When the temperature of the EGR gas is low, such as just after the start of the engine 16, the EGR gas is heated to a temperature higher than the condensation temperature by using the engine cooling water. So, the condensation of the EGR gas is prevented so that the exhaust gas recirculation system 1 can be operated at an early stage. The exhaust gas heat exchanger 20 performs the heat exchange for the purpose of heat absorption of the EGR gas. When the temperature of the EGR gas is high, for example, after completion of warming-up of the engine 16, the heat of the EGR gas is stored. The temperature of the EGR gas is reduced and a gas density is increased. Accordingly, a loss of the engine 16 is reduced and a knocking is prevented. The EGR gas with an appropriate temperature by performing the heat exchange is introduced in the intake pipe 17 through the second EGR pipe 4. The temperature of the engine cooling water that can start the heat exchange by means of the exhaust gas heat exchanger 20 and the EGR gas may be higher than the condensation temperature of the EGR gas. In detail, the temperature of 40° C. or higher is preferable.

The exhaust gas recirculation system 1 has a control unit (ECU) 15. The control unit 15 is electrically connected to the EGR valve 14, the heat storage temperature sensor 55, the cooling water temperature sensor 61, and the valve 63. The control unit 15 is connected to an ignition switch 90 and a battery 91. The control unit 15 controls to start or stop the engine 16 upon a detection of ON/OFF of the ignition switch 90. The control unit 15 regulates a valve opening based on the temperatures measured by the cooling water temperature sensor 61 and the heat storage temperature sensor 55. Details regarding the control of the valve opening of the valve 63 will be later explained.

Figure 2:
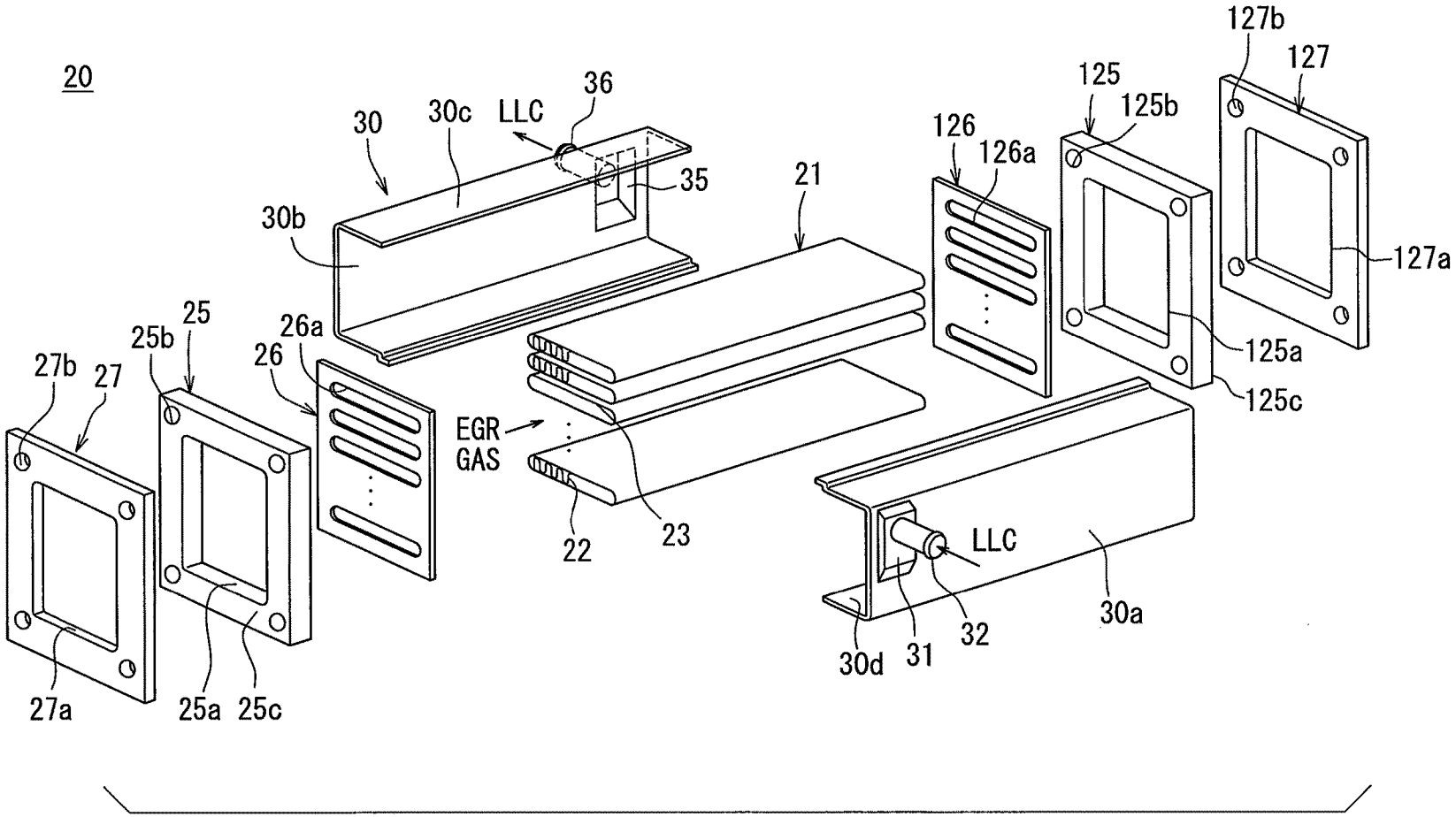
FIG. 2 is a diagram illustrating a disassembled perspective view showing an exhaust gas heat exchanger in a first embodiment.

In FIG. 2, the exhaust gas heat exchanger 20 includes a tube 21, a casing 30, an inlet side flange 25, an outlet side flange 125, an inlet side core plate 26, and an outlet side core plate 126 as components. A plurality of the tubes 21 are stacked and arranged in lamination. The exhaust gas heat exchanger 20 is formed in a rectangular shape.

An inner fin 22 is provided inside of the inner tube 21. The inner fin 22 is corrugated in a cross section. The inner fin 22 is uniformly provided from one end of the tube 21 to the other end thereof.

An end portion of the tube 21 which is positioned at the inlet side of the FGR gas is connected to the inlet side core plate 26. The inlet side core plate 26 has a plurality of hole portions **26*a*. The hole portions 26*a* are provided in parallel at a predetermined intervals. The end portion of the tube 21 which is positioned at the inlet side of the FGR gas is fitted in the hole portion 26*a* and fixed by joining. The inlet side flange 25 is joined and fixed to outside of the inlet side core plate 26. The inlet side flange 25 has an inlet side opening 25*a* in the center part and is formed in a quadrangular and cylindrical shape. The inlet side opening 25*a* forms a space in which the EGR gas is divided into the plural tubes 21. Four mounting holes 25*b* are formed at the four corners of the inlet side flange 25 in order to fix the exhaust gas heat exchanger 20** at a predetermined position by inserting bolts or the like.

The inlet side flange 25 has an inlet side connecting surface 25*c* constituting a part of an outer surface of the exhaust gas heat exchanger 20. The inlet side connecting surface 25*c* constitutes a connecting surface for connecting between the first EGR pipe 3 and the inlet side flange 25.

An inlet side heat insulating member 27 are provided on the inlet side flange 25. The inlet side heat insulating member 27 is mounted on the inlet side connecting surface 25*c*. The inlet side heat insulating member 27 is directly pasted and fixed to the inlet side connecting surface 25*c*. The inlet side heat insulating member 27 has an inlet side heat insulating member opening 27*a* in the center part and is formed in a quadrangular and sheet shape. Four mounting holes 27*b* are formed at the four corners of the inlet side heat insulating member 27 in order to fix the exhaust gas heat exchanger 20 at a predetermined position by inserting bolts or the like. The inlet side heat insulating member 27 is a foamed heat insulating material having independent air bubbles. The inlet side heat insulating member 27 forms a heat insulating layer having a structural features in which an individual thermal conductivity as the heat insulating material is lower and a bubble-like cavity is formed inside thereof. The inlet side heat insulating member 27 has a heat insulating function for providing the heat insulating layer in order to reduce a heat exchange from the inlet side flange 25. The inlet side heat insulating member 27 has a sealing function of preventing the fluid from leaking in the connection between the pipes. The inlet side heat insulating member 27 may be made of a material which has both of the heat insulating function and the sealing function, and may not be limited to the foamed heat insulating material having independent air bubbles.

Figure 3:
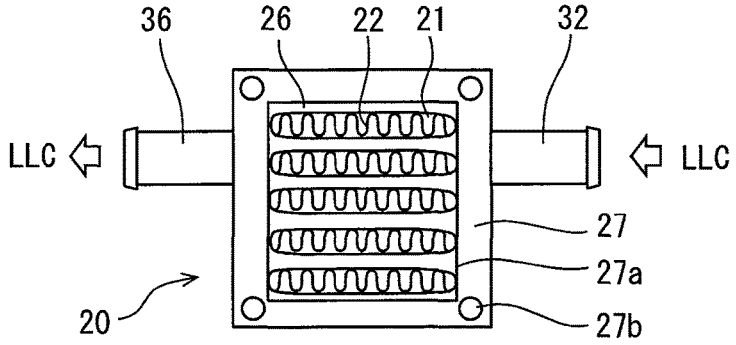
FIG. 3 is a diagram illustrating a plan view showing the exhaust gas heat exchanger in the first embodiment.

In FIG. 3, the inlet side heat insulating member 27 is provided to cover the entire inlet side connecting surface 25*c*. Namely, one piece of the inlet side heat insulating member 27 covers both an inner peripheral edge and an outer peripheral edge of the inlet side connecting surface 25*c*.

Figure 4:
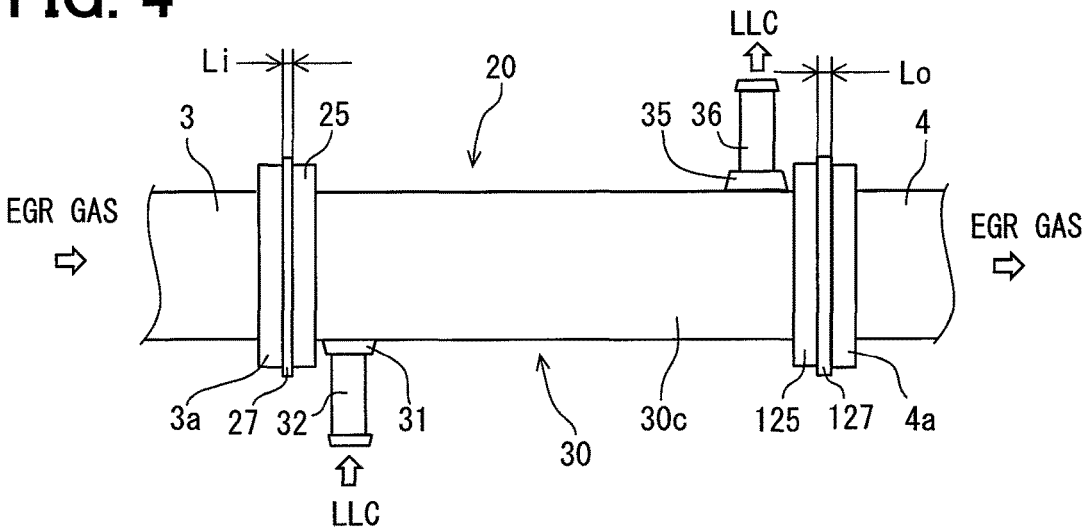
FIG. 4 is a diagram illustrating a top view showing the exhaust gas heat exchanger in the first embodiment.

In FIG. 4, the first EGR pipe 3 has an upstream flange 3*a* that connects to the inlet side flange 25. The upstream flange 3*a* extends outwardly from the end portion of the first EGR pipe 3. Four mounting holes are formed at the four corners of the upstream flange 3*a* in order to fix the exhaust gas heat exchanger 20 at a predetermined position by inserting bolts or the like. The exhaust gas heat exchanger 20 communicates with the first EGR pipe 3 by connecting between the inlet side flange 25 and the upstream flange 3*a* by means of the bolt or the like.

In FIG. 2, an end portion of the tube 21 which is positioned at the outlet side of the EGR gas is connected to the outlet side core plate 126. The outlet side core plate 126 has a plurality of hole portions 126*a*. The hole portions 126*a* are provided in parallel at a predetermined intervals. The end portion of the tube 21 which is positioned at the outlet side of the EGR gas is fitted in the hole portion 126*a* and fixed by joining. The outlet side flange 125 is joined and fixed to outside of the outlet side core plate 26. The outlet side flange 125 has an outlet side opening 125*a* in the center part and is formed in a quadrangular and cylindrical shape. The outlet side opening 125*a* forms a space in which the EGR gas is divided into the plural tubes 21. Four mounting holes 125*b* are formed at the four corners of the outlet side flange 125 in order to fix the exhaust gas heat exchanger 20 at a predetermined position by inserting bolts or the like.

The outlet side flange 125 has an outlet side connecting surface 125*c* constituting a part of an outer surface of the exhaust gas heat exchanger 20. The outlet side connecting surface 125*c* constitutes a connecting surface for connecting and fixing between the second EGR pipe 4 and the outlet side flange 125.

An outlet side heat insulating member 127 are provided on the outlet side flange 125. The outlet side heat insulating member 127 is mounted on the outlet side connecting surface 125*c*. The outlet side heat insulating member 127 is directly pasted and fixed to the outlet side connecting surface 125*c*. The outlet side heat insulating member 127 has an outlet side heat insulating member opening 127*a* in the center part and is formed in a quadrangular and sheet shape. Four mounting holes 127*b* are formed at the four corners of the outlet side heat insulating member 127 in order to fix the exhaust gas heat exchanger 20 at a predetermined position by inserting bolts or the like. The outlet side heat insulating member 127 is a foamed heat insulating material having independent air bubbles. The outlet side heat insulating member 127 forms a heat insulating layer having a structural features in which an individual thermal conductivity as the heat insulating material is lower and a bubble-like cavity is formed inside thereof. The outlet side heat insulating member 127 has a heat insulating function for providing the heat insulating layer in order to reduce a heat exchange from the outlet side flange 125. The outlet side heat insulating member 127 has a sealing function of preventing the fluid from leaking in the connection between the pipes. The outlet side heat insulating member 127 may be made of a material which has both the heat insulating function and the sealing function, and may not be limited to the foamed heat insulating material having independent air bubbles.

In FIG. 4, the second EGR pipe 4 has a downstream flange 4*a* that connects to the outlet side flange 125. The downstream flange 4*a* extends outwardly from the end portion of the second EGR pipe 4. Four mounting holes are formed at the four corners of the downstream flange 4*a* in order to fix the exhaust gas heat exchanger 20 at a predetermined position by inserting bolts or the like. The exhaust gas heat exchanger 20 communicates with the second EGR pipe 4 by connecting and fixing between the outlet side flange 125 and the downstream flange 4*a* by means of the bolt or the like.

In FIG. 2, the casing 30 is composed of two casings superimposed and joined together. The casing 30 is formed in a squire tubular shape. An outer surface of the squire tubular shaped casing 30 is composed of four rectangular surfaces which are an inlet surface, an outlet surface, a top surface, and a bottom surface.

The inlet surface 30*a* is one surface of plural surfaces constituting the outer surface of the casing 30. A water inlet pipe 32 is provided on the inlet surface 30*a*. The inlet surface 30*a* constitutes a side surface of the exhaust gas heat exchanger 20 in a state that the exhaust gas heat exchanger 20 is installed. The inlet surface 30*a* is the surface on which the introduced engine cooling water firstly performs heat exchange with the EGR gas. Namely, the inlet surface 30*a* is the surface where the temperature difference between the EGR gas and the casing 30 is most likely to occur on each surface of the casing 30.

The outlet surface 30*b* is one surface of plural surfaces constituting the outer surface of the casing 30. A water outlet pipe 36 is provided on the outlet surface 30*b*. The outlet surface 30*b* constitutes a side surface of the exhaust gas heat exchanger 20 in a state that the exhaust gas heat exchanger 20 is installed. The outlet surface 30*b* is the surface through which the engine cooling water flows after the heat exchange with the EGR gas. Namely, the outlet surface 30*b* is the surface where the temperature difference between the EGR gas and the casing 30 is the least likely to occur on each surface of the casing 30. The inlet surface 30*a* and the outlet surface 30*b* are arranged in parallel with each other.

The top surface 30*c* constitutes a top side of the exhaust gas heat exchanger 20 in a state that the exhaust gas heat exchanger 20 is installed. The bottom surface 30*d* constitutes a bottom side of the exhaust gas heat exchanger 20 in a state that the exhaust gas heat exchanger 20 is installed. The top surface 30*c* and the bottom surface 30*d* are arranged in parallel with each other.

The outer surfaces of the exhaust gas heat exchanger 20 has one group of surfaces which connect to components other than the exhaust gas heat exchanger 20 and other group of surfaces which constitute the outside of the exhaust gas heat exchanger 20. Namely, the outer surfaces of the exhaust gas heat exchanger 20 are composed of the inlet side flange 25, the outlet side flange 125, and the casing 30. In detail, the outer surfaces of the exhaust gas heat exchanger 20 are composed of six surfaces, namely the inlet side connecting surface 25*c*, the outlet side connecting surface 125*c*, the inlet surface 30*a*, the outlet surface 30*b*, the top surface 30*c*, and the bottom surface 30*d*. The outer surface may be the surface exposed to the outside, and it is not limited to the six surfaces described above.

A first protrusion 31 projecting outward is formed on the inlet surface 30*a* of the casing 30. The first protrusion 31 is provided at a position closer to the inlet side flange 25 than the outlet side flange 125. The casing 30 has a second protrusion 35 on the outlet surface 30*b* in the opposite side of the inlet surface 30*a* having the first protrusion 31 through the tube 21. The second protrusion 35 is provided at a position closer to the outlet side flange 125 than the inlet side flange 25.

An inlet side pipe hole is provided on the first protrusion 31. A water inlet pipe 32 into which the engine cooling water is introduced is fitted and joined to the inlet side pipe hole. The water inlet pipe 32 is connected to the cooling water introduction pipe 6. An outlet side pipe hole is provided on the second protrusion 35. A water outlet pipe 36 from which the engine cooling water is flowed out is fitted and joined to the outlet side pipe hole. The water outlet pipe 36 is connected to the cooling water outflow pipe 7.

In FIG. 3, the water inlet pipe 32 and the water outlet pipe 36 are provided at substantially the same height. Plural tubes 21 are provided in parallel with each other.

In FIG. 2, gaps used as the cooling water flow path 23 are formed between the casing 30 and the tube 21, and between the adjacent tubes 21. Namely, the engine cooling water is introduced from the water inlet pipe 32 and is expanded into the inside of the casing 30 from the first protrusion 31.

The engine cooling water introduced into the inside of the casing 30 flows along an outer surface of the tube 21. In other words, the engine cooling water flows in the cooling water flow path 23 which is a gap in a closed space formed by the tube 21, the casing 30, the inlet side core plate 26, and the outlet side core plate 126.

Part of the engine cooling water flows in the cooling water flow path 23 while contacting the outer surface of the tube 21 and exchanging heat. The EGR gas flows inside of the tube 21. So, the engine cooling water exchanges heat with the EGR gas flowing in the tube 21. Part of the engine cooling water flows in the cooling water flow path 23 while contacting the rear surface of the inlet side core plate 26 and exchanging heat. The EGR gas before heat exchanging in the tube 21 flows on the front side of the inlet side core plate 26. So, the engine cooling water exchanges heat with the EGR gas before flowing in the tube 21. Part of the engine cooling water flows in the cooling water flow path 23 while contacting the rear surface of the outlet side core plate 126 and exchanging heat. The EGR gas after heat exchanging in the tube 21 flows on the front side of the outlet side core plate 126. So, the engine cooling water exchanges heat with the EGR gas after flowing in the tube 21. Part of the engine cooling water flows in the cooling water flow path 23, while contacting the rear surface of the casing 30 and exchanging heat. The outer surface of the casing 30 exposes to outside air. Accordingly, the engine cooling water exchanges heat with outside air.

As mentioned above, the engine cooling water exchanges heat during flowing through the cooling water flow path 23, and flows toward the second protrusion 35 of the casing 30. The engine cooling water which arrives at the second protrusion 35 is flowed out from the water outlet pipe 36.

The heat of the casing 30 exchanged with the engine cooling water is transferred to the inlet side flange 25 and the outlet side flange 125. In other words, the casing 30 is constructed so as to be directly contacted and in a heat transferable state with respect to the inlet side flange 25 and the outlet side flange 125. The heat of the inlet side core plate 26 exchanged with the engine cooling water is transferred to the inlet side flange 25 which be in contact thereto. The heat of the outlet side core plate 126 exchanged with the engine cooling water is transferred to the outlet side flange 125 which be in contact thereto. The casing 30, the inlet side flange 25, and the outlet side flange 125 which are component parts of the exhaust gas heat exchanger 20 dissipates the heat obtained by heat exchange with the engine cooling water to the outside air.

Since each component part constituting the exhaust gas heat exchanger 20 comes into direct contact with the EGR gas of the engine 16 and the engine cooling water, each component part is made of a material excellent in corrosion resistance and high temperature strength. Each component part constituting the exhaust gas heat exchanger 20 is made of aluminum material or stainless steel material or the like. Each component part constituting the exhaust gas heat exchanger 20 is bonded to each other by brazing or welding.

In FIG. 3, the inlet side heat insulating member 27 is provided to cover the outer peripheral edge of the inlet side connecting surface 25*c* of the inlet side flange 25. Namely, the inlet side heat insulating member 27 is slightly larger in side than the inlet side flange 25. The outer peripheral edge is an edge located on the outermost side of the inlet side connecting surface 25*c*. The outer peripheral edge constitutes a corner of the inlet side flange 25. The outlet side heat insulating member 127 is provided to cover the outer peripheral edge of the outlet side connecting surface 125*c* like the inlet side heat insulating member 27.

In FIG. 4, the first EGR pipe 3 and the exhaust gas heat exchanger 20 are fixed by bolts. When the first EGR pipe 3 and the exhaust gas heat exchanger 20 are fixed, the inlet side heat insulating member 27 is interposed between the upstream flange 3*a* and the inlet side flange 25. In other words, the first EGR pipe 3 and the exhaust gas heat exchanger 20 are not directly contacted by means of the inlet side heat insulating member 27. So, the inlet side heat insulating member 27 is provided on the heat transfer path to the first EGR pipe 3 corresponding to the outside of the exhaust gas heat exchanger 20. A washer with high thermal insulation is provided between the bolts and the inlet side flange 25. Accordingly, heat transfer from the exhaust gas heat exchanger 20 to the first EGR pipe 3 via the bolts is suppressed.

The second EGR pipe 4 and the exhaust gas heat exchanger 20 are fixed by bolts. When the second EGR pipe 4 and the exhaust gas heat exchanger 20 are fixed, the outlet side heat insulating member 127 is interposed between the downstream flange 4*a* and the outlet side flange 125. In other words, the second EGR pipe 4 and the exhaust gas heat exchanger 20 are not directly contacted by means of the outlet side heat insulating member 127. So, the outlet side heat insulating member 127 is provided on the heat transfer path to the second EGR pipe 4 corresponding to the outside of the exhaust gas heat exchanger 20. A washer with high thermal insulation is provided between the bolts and the outlet side flange 125. Accordingly, heat transfer from the exhaust gas heat exchanger 20 to the second EGR pipe 4 via the bolts is suppressed.

A thickness Lo of the outlet side heat insulating member 127 is thicker than that of the inlet side heat insulating member 27. Namely, the outlet side heat insulating member 127 has higher thermal insulation performance in comparison with the inlet side heat insulating member 27.

Figure 5:
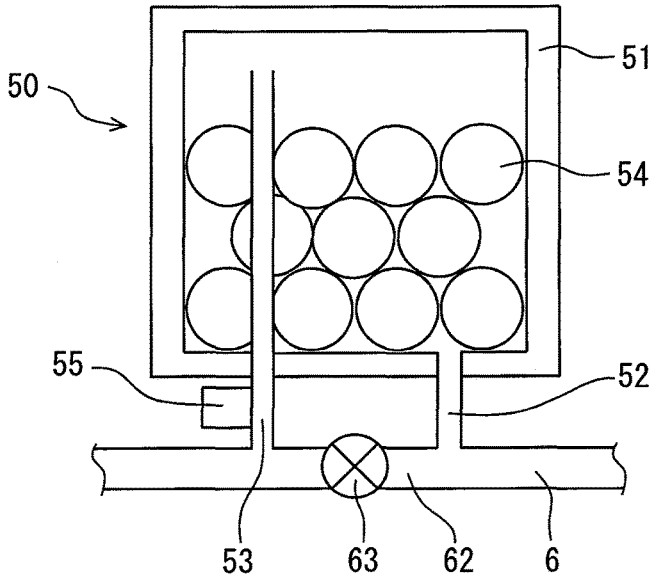
FIG. 5 is a diagram illustrating a schematic view showing a heat storage device.

In FIG. 5, the heat storage device 50 has a heat storage housing 51. The heat storage housing 51 is a vacuum double tube structure with a vacuum region between the inside and the outside. An inlet connecting pipe 52 introducing the engine cooling water communicates with the inside of the heat storage housing 51. The inlet connecting pipe 52 is connected to a bottom of the interior of the heat storage housing 51. The inlet connecting pipe 52 communicates between the inside of the heat storage housing 51 and the cooling water introduction pipe 6. An outlet connecting pipe 53 for discharging the engine cooling water communicates with the inside of the heat storage housing 51. The outlet connecting pipe 53 is provided to extend from the bottom of the interior of the heat storage housing 51 to a top thereof. The outlet connecting pipe 53 communicates between the inside of the heat storage housing 51 and the cooling water introduction pipe 6. A heat storage temperature sensor 55 is provided on the outlet connecting pipe 53.

The heat storage housing 51 has a plurality of the heat storage capsules 54 inside. The heat storage capsule 54 is a spherical capsule filled with heat storage material inside. A heat storage material that accumulates heat by a change in phase between a solid phase and a liquid phase having a small volume change is preferable. As an example of the specific heat storage material, a paraffin wax is available. Since the heat storage material that accumulates heat by a change in phase between a solid phase and a liquid phase having a small volume change is utilized, the heat storage device 50 which is small in size can store a lot of heat. As a latent heat storage material, fatty oxidized substances such as lauric acid and substances based on saccharides such as xylitol can also be available. The heat storage material that can be used is not limited to the latent heat storage material, and water may be used as the sensible heat storage material.

When the engine cooling water circulates through the heat storage device 50, the engine cooling water introduces into the inside of the heat storage housing 51 from the inlet connecting pipe 52. The engine cooling water is introduced from the bottom of the heat storage housing 51 and transfers toward the top. While the engine cooling water moves, the engine cooling water contacts the heat storage capsules 54 and performs heat exchange. If the temperature Tw which is the temperature of the engine cooling water is low, the heat storage capsules 54 radiates heat to the engine cooling water and heats the engine cooling water. Namely, it functions as a heating means. If the temperature Tw of the engine cooling water is high, the heat storage capsules 54 receives heat from the engine cooling water and accumulates heat.

The heat storage capsules 54 works as a resistance which decreases a flow velocity with respect to the flow of the engine cooling water. When the valve 63 is in an open state, the engine cooling water passes through the bypass pipe 62 which has a smaller flow resistance. When the engine cooling water passes through the heat storage device 50, the flow resistance becomes larger. The amount of the engine cooling water which can be used for cooling the engine decreases as compared with the case which the engine cooling water flows through the bypass pipe 62. The engine cooling water subjected to heat exchange with the capsules 54 returns to the cooling water introduction pipe 6 from the outlet connecting pipe 53.

Figure 6:
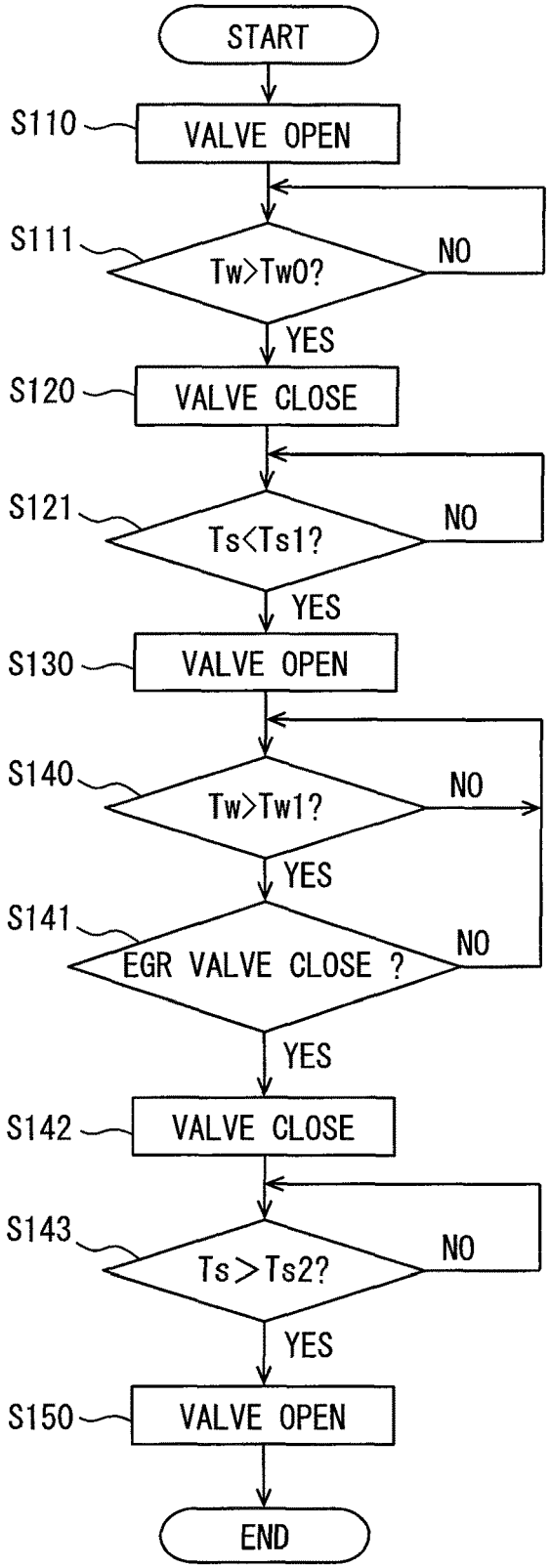
FIG. 6 is a diagram illustrating a flow chart showing valve control in the exhaust gas recirculation system.

Next, a control processing of valve 63 in the exhaust gas recirculation is explained. In FIG. 6, the EGR valve 14 is opened and the exhaust gas recirculation is started. In step S110, the valve 63 is opened. At the point of time in step S110, the engine cooling water passes through the bypass pipe 62 which has a smaller flow resistance without passing through the heat storage device 50 which has a lager flow resistance.

Step S111 determines whether the cooling water temperature Tw measured by the cooling water temperature sensor 61 is higher than the water temperature Tw0 at which heat radiation starts. The radiation start water temperature Tw0 is, for example, 50° C. A state in which the engine cooling water passes through the bypass pipe 62 continues before the cooling water temperature Tw becomes higher than the radiation start water temperature Tw0. During this time, the engine cooling water exchanges heat with the engine 16, and stores heat of the engine 16. The engine cooling water exchanges heat with the EGR gas and the heat of the engine 16 is stored in the engine cooling water. Accordingly, the cooling water temperature Tw gradually increases. After the cooling water temperature Tw becomes higher than the radiation start water temperature Tw0, step S120 will be executed.

In step S120, the valve 63 is closed. At the point of time in step S120, the engine cooling water passes through the heat storage device 50. Step S121 determines whether the heat storage device temperature Ts measured by the heat storage temperature sensor 55 is lower than the temperature Ts1 at which heat radiation is completed. The heat radiation completion temperature Ts1 is, for example, 60° C. The heat radiation completion temperature Ts1 is not limited to a fixed value, and the cooling water temperature Tw may be used as the heat radiation completion temperature Ts1. A state in which the engine cooling water passes through the heat storage device 50 continues before the heat storage device temperature Ts becomes lower than the heat radiation completion temperature Ts1. In other words, the heat storage device 50 continues to radiate heat to the engine cooling water, until the heat storage device temperature Ts becomes lower than the heat radiation completion temperature Ts1. Step S120 and S121 shows the heat radiation mode in which the heat storage device 50 radiates heat to the engine cooling water. After the heat storage device temperature Ts becomes lower than the heat radiation completion temperature Ts1, Step S130 will be executed.

In step S130, the valve 63 is opened. At the point of time in step S130, the engine cooling water does not pass through the heat storage device 50 and passes through the bypass pipe 62. During step S130, the heat storage device 50 does not radiate heat or store heat with respect to the engine cooling water.

Step S140 determines whether the cooling water temperature Tw is higher than the heat storage start water temperature Tw1. The heat storage start water temperature Tw1 is, for example, 80° C. A state in which the engine cooling water passes through the bypass pipe 62 continues before the cooling water temperature Tw becomes higher than the heat storage start water temperature Tw1. During this time, the engine cooling water stores heat of the engine 16 in order to cool the engine 16. The engine cooling water stores heat of the EGR gas in order to cool the EGR gas. Accordingly, the cooling water temperature Tw gradually increases. After the cooling water temperature Tw becomes higher than the heat storage start water temperature Tw1, step S141 will be executed.

Step S141 determines whether the EGR valve 14 is closed or not. A state in which the EGR valve 14 is opened shows that the exhaust gas recirculation is continued. If the EGR valve is opened, return to step S140. Namely, when the cooling water temperature Tw is higher than the heat storage start water temperature Tw1 and the EGR valve 14 is closed, step S142 will be executed.

In step S142, the valve 63 is closed. At the point of time in step S142, the engine cooling water passes through the heat storage device 50. Step S143 determines whether the heat storage device temperature Ts measured by the heat storage temperature sensor 55 is higher than the temperature Ts2 at which heat storage is completed. The heat storage completion temperature Ts2 is, for example, 80° C. The heat storage completion temperature Ts2 is not limited to a fixed value, and the cooling water temperature Tw may be used as the heat storage completion temperature Ts2. In this case, a determination is made as to whether or not the cooling water temperature Tw is maintained at a predetermined temperature, while the engine cooling water passes through the heat storage device 50. A state in which the engine cooling water passes through the heat storage device 50 continues until the heat storage device temperature Ts becomes higher than the heat storage completion temperature Ts2. In other words, the heat storage device 50 continues to store heat from the engine cooling water, until the heat storage device temperature Ts becomes higher than the heat storage completion temperature Ts2. Step S142 and S143 show the heat storage mode in which the heat storage device 50 stores heat from the engine cooling water. After the heat storage device temperature Ts becomes higher than the heat storage completion temperature Ts2, Step S150 will be executed.

In step S150, the valve 63 is opened. At the point of time in step S150, the engine cooling water does not pass through the heat storage device 50 and passes through the bypass pipe 62. During step S150, the heat storage device 50 does not radiate heat or store heat with respect to the engine cooling water.

In the above mentioned embodiment, a leak of heat generated by the contact between the inlet side flange 25 and the upstream flange 3*a* is suppressed by means of the inlet side heat insulating member 27. Furthermore, other leak of heat generated by the contact between the outlet side flange a25 and the downstream flange 4*a* is suppressed by means of the outlet side heat insulating member 127. Accordingly, it is easy to maintain the exhaust gas heat exchanger 20 at high temperature. When the EGR gas is heated, the heat exchange can be effectively performed.

The inlet side heat insulating member 27 covers both the inner peripheral edge and the outer peripheral edge of the inlet side connecting surface 25*c* of the inlet side flange 25. Accordingly, the leak of heat generated by the contact between the inlet side flange 25 and the upstream flange 3*a* can be effectively suppressed. The outlet side heat insulating member 127 covers both the inner peripheral edge and the outer peripheral edge of the outlet side connecting surface 125*c* of the inlet side flange 125. Accordingly, the leak of heat generated by the contact between the outlet side flange 125 and the downstream flange 4*a* can be effectively suppressed. It is possible to effectively suppress the temperature decrease of the engine cooling water around the outlet side flange 125.

The outlet side heat insulating member 127 has higher thermal insulation performance in comparison with the inlet side heat insulating member 27. It is possible to effectively prevent the temperature of the EGR gas warmed by heat exchange from lowering. As a method for enhancing the thermal insulating performance, it is not limited to increase the thickness of the heat insulating member. It is possible to select a heat insulating member with a high thermal insulating performance. The inlet side heat insulating member 27 and the outlet side heat insulating member 127 may be the same thickness and the same heat insulating material. In this case, the workability during manufacturing can be improved, since the inlet side heat insulating member 27 and the outlet side heat insulating member 127 are the same heat insulating material.

When the engine 16 is operated, heat of the engine cooling water is stored, and the stored heat is used for heat exchange in the exhaust gas heat exchanger 20. It is possible to perform the exhaust gas recirculation at an early stage after starting the engine 16 while preventing deterioration of fuel consumption by using another heat source such as a combustion type heater.

The bypass pipe 62 is provided in such a manner that the engine cooling water does not pass through the heat storage device 50. When there is no need to perform heat exchange between the engine cooling water and the heat storage device 50, by passing it through the bypass pipe 62, it is possible to maintain the state in which the heat storage device 50 stores heat for a long time.

The heat storage temperature sensor 55 for measuring the heat storage device temperature Ts is provided on the outlet connecting pipe 53. Accordingly, the heat storage temperature sensor 55 can measure the temperature close to the final exit temperature at which heat exchange with the engine cooling water is completed. The installation position of the heat storage temperature sensor 55 is not limited to the outlet connecting pipe 53. The heat storage temperature sensor 55 may be provided inside of the heat storage housing 51. When the heat storage temperature sensor 55 is provided inside of the heat storage housing 51, the temperature of the engine cooling water during heat exchange in the heat storage housing 51 is measured as the heat storage device temperature Ts.

In step S141, when the EGR valve 14 is opened, the valve 63 is not closed. During the exhaust gas recirculation, the engine cooling water is circulated through the bypass pipe 62. Accordingly, since large amount of circulating engine cooling water is secured, it is possible to prevent the cooling shortage of the engine 16 during the exhaust gas recirculation. Step S141 may be omitted. Namely, the valve 63 may be closed, regardless of whether the EGR valve 14 is open or close. In this case, the heat storage device 50 can accumulate heat, while the exhaust gas recirculation continues. Accordingly, it is possible to complete the heat storage as quick as possible.

When the valve 63 is open, all amount of the engine cooling water may not be passed through the bypass pipe 62. Namely, almost amount of the engine cooling water may be passed through the bypass pipe 62, and some amount of the engine cooling water may be introduced into the heat storage device 50. When the valve is close, all amount of the engine cooling water may not be passed through the heat storage device 50. Namely, almost amount of the engine cooling water may be passed through the heat storage device 50, and some amount of the engine cooling water may be introduced into the bypass pipe 62.

Step S110 and step S111 may be omitted. After the exhaust gas recirculation is started, step S120 may be executed. In this situation, regardless of the temperature of the engine cooling water at a starting time of the exhaust gas recirculation, heat radiation is performed by the heat storage device 50. Accordingly, the heat storage device 50 can start performing the heat radiation so quickly with respect to the engine cooling water.

In step S130, the valve 63 may be in a half-opened state instead of in a completely opened state. In the half-opened state of the valve 62, the flow rate in the bypass pipe 62 is limited. According to this state, at the time of step S130, the engine cooling water is divided into two paths, that is, the heat storage device 50 and the bypass pipe 62, and passes through two paths. During the process of step S130, it is possible to store the heat by the heat storage device 50 while cooling the engine.

Instead of step S143, the process may proceed to step S150, if it is determined that the engine 16 is off. That is, even when the temperature of the heat storage device 50 reaches a temperature higher than the heat storage start water temperature Tw1, the heat storage is continued. According to this, since the heat storage is continued until the engine 16 is turned off, much heat can be stored in the heat storage device 50 at the time when the engine 16 is turned off. Therefore, when starting the exhaust gas recirculation next time, it is possible to start from a state where more heat is stored, so that more heat can be dissipated to the engine cooling water.

In the above embodiment, the heat storage device 50 is explained as the heating means, however, heating may be performed by a combustion heater or the like.

Second Embodiment

The exhaust gas heat exchanger 20 has the casing 30 forming the outer surface of the exhaust gas heat exchanger 20, each surface of which is covered by the casing surface heat insulating member 227.

Figure 7:
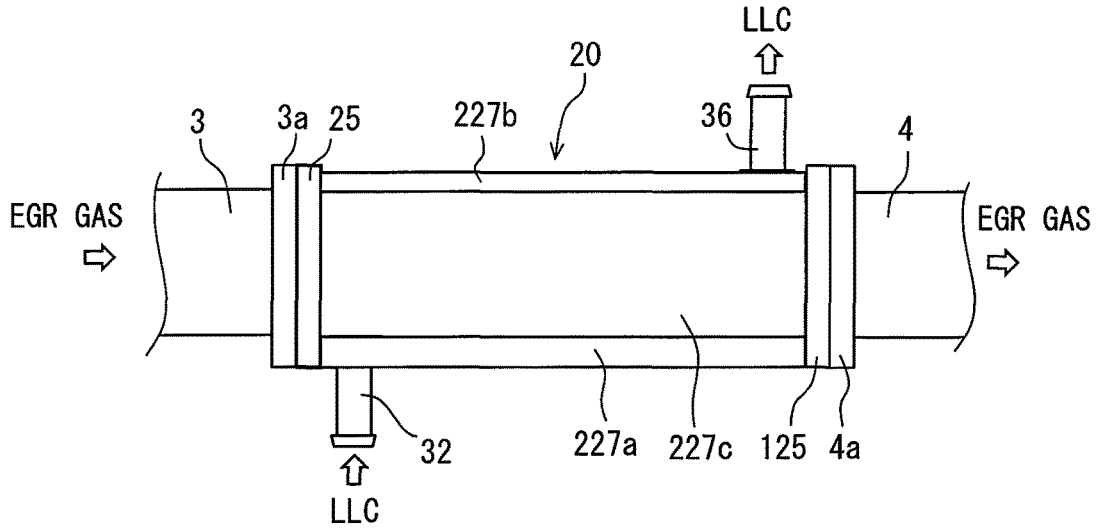
FIG. 7 is a diagram illustrating a top view showing the exhaust gas heat exchanger in a second embodiment.

In FIG. 7, the exhaust gas heat exchanger 20 is provided with an inlet surface heat insulating member 227*a* on the inlet surface 30*a*. The exhaust gas heat exchanger 20 is provided with an outlet surface heat insulating member 227*b* on the outlet surface 30*b* having the water outlet pipe 36. The exhaust gas heat exchanger 20 is provided with a top surface heat insulating member 227*c* on the top surface 30*c*. The top surface heat insulating member 227*c* is formed in a rectangular panel shape. The top surface heat insulating member 227*c* continuously covers from the inlet side flange 25 to the outlet side flange 125.

The casing surface heat insulating member 227 is fixed to each surface of the casing 30 so as to directly contact each surface thereof. In other words, the casing surface heat insulating member 227 is provided on a heat transfer path to the air corresponding to the outside of the exhaust gas heat exchanger 20.

The inlet surface heat insulating member 227*a* has a thickness larger than the outlet surface heat insulating member 227*b*. That is, the inlet surface heat insulating member 227*a* has higher heat insulating performance than the outlet surface heat insulating member 227*b*.

Figure 8:
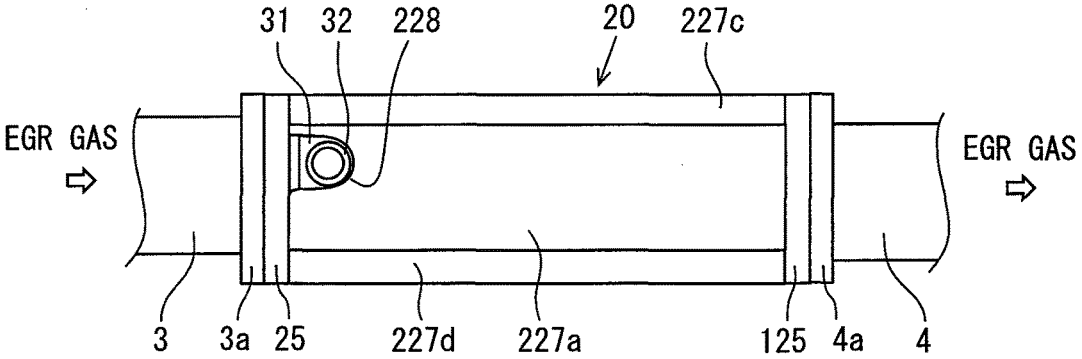
FIG. 8 is a diagram illustrating a side view showing the exhaust gas heat exchanger in the second embodiment.

In FIG. 8, the exhaust gas heat exchanger 20 has a bottom surface heat insulating member 227*d* on the bottom surface 30*d*. The inlet surface heat insulating member 227*a* is provided with notch 228 so as to avoid the water inlet pipe 32. The inlet surface heat insulating member 227*a* continuously covers from the inlet side flange 25 to the outlet side flange 125. The inlet surface heat insulating member 227*a* covers the inlet surface 30*a* including the first protrusion 31.

The casing surface heat insulating member 227 is a heat insulating panel formed of glass wool. The heat insulating material of the casing surface heat insulating member 227 is a heat insulating material which itself forms a heat insulating layer. That is, the heat insulating layer has a high thermal insulating performance which is formed by low solid thermal conductivity of the glass wool itself and a fibrous structure. The heat insulating material of the casing surface heat insulating member 227 is not limited to glass wool. For example, urethane foam, expanded polystyrene, silica fiber, porous ceramic and the like can be used.

All four surfaces, which are outer peripheral surfaces of the casing 30, are covered with the casing surface heat insulating member 227. Therefore, it is possible to reduce heat radiation due to natural convection from the exhaust gas heat exchanger 20 into the air, thereby suppressing the temperature decrease of the exhaust gas heat exchanger 20. Therefore, in the exhaust gas heat exchanger 20, it is possible to effectively perform the heat exchange and to raise the temperature of the EGR gas.

The inlet surface heat insulating member 227*a* covering the inlet surface 30*a* having the water inlet pipe 32 has higher heat insulating performance than the casing surface heat insulating members 227 covering the other surfaces. Thus, when the EGR gas is heated by the engine cooling water, heat radiation to the air can be suppressed at the inlet surface 30*a* where the temperature of the engine cooling water is highest. Therefore, it is possible to effectively heat the engine cooling water.

The thickness of the casing surface heat insulating member 227 may be increased so as to increase the heat insulating performance as approaching from the vicinity of the inlet of the EGR gas to the vicinity of the outlet. That is, the heat insulating performance in the vicinity of the outlet of the EGR gas may be maximized. According to this, the temperature decrease of the EGR gas heated by the engine cooling water can be suppressed more effectively.

The material of the water inlet tube 32 may be used as a material having a higher heat insulating performance than that of the tube 21. For example, a resin water inlet pipe 32 can be used with respect to the metal tube 21. The energy radiated from the engine cooling water before the heat exchange with the EGR gas into the air via the water inlet pipe 32 can be reduced.

The outer peripheral surface of the exhaust gas heat exchanger 20 is not limited to the four surfaces of the inlet surface 30*a*, the outlet surface 30*b*, the top surface 30*c*, and the bottom surface 30*d*. For example, the water inlet pipe 32 and the water outlet pipe 36 may be provided on the same surface. For example, a water outlet pipe 36 may be provided on the top surface 30*c*.

The casing 30 is not limited to a quadrangular square tubular shape. For example, it may be formed in a hexagonal square tubular shape or a cylindrical shape.

The casing surface heat insulating member 227 is not limited to a rectangular panel divided into each surface. For example, the inlet surface 30*a*, the outlet surface 30*b*, the top surface 30*c*, and the bottom surface 30*d* may be covered with a single continuous heat insulating material.

The casing surface heat insulating member 227 may not be completely covered so that the outer surface of the casing 30 is not exposed to the outside. That is, most of the outer surface of the casing 30 may be covered. For example, a rectangular heat insulation panel of a size small enough to expose a portion where the water inlet pipe 32 is disposed may be provided without providing the notch 228 on the inlet surface heat insulating member 227*a*. According to this, since it is unnecessary to process the heat insulating member into a complicated shape, it can be easily manufactured.

According to the above described embodiment, in the exhaust gas heat exchanger 20, efficient heat exchange can be performed when the EGR gas is heated by using the engine cooling water.

The heat insulating members 27, 127, 227 are provided on the heat transfer path from the exhaust gas heat exchanger 20 to the outside. Therefore, it is possible to reduce heat loss and heat radiation by the heat transfer from the exhaust gas heat exchanger 20 to the outside. In other words, in the exhaust gas heat exchanger 20, it is possible to efficiently perform heat exchange between the engine cooling water and the EGR gas. When the heat storage device 50 is used as heating means, the amount of energy that can be stored is limited. In addition, loss of energy due to lapse of time from storage of heat to radiation of heat occurs. However, since efficient heat exchange can be realized as described above, it is possible to downsize the heat storage device 50. When a combustion type heater is used as the heating means, a large amount of fuel is consumed by the combustion heater. However, since efficient heat exchange can be realized as described above, the amount of fuel used in the combustion heater can be reduced.

Other Embodiment

The disclosure in this specification is not limited to the illustrated embodiment. The disclosure encompasses the illustrated embodiments and modifications by the skilled person in the art based thereon. For example, the disclosure is not limited to the parts and/or combinations of elements shown in the embodiments. Disclosure can be implemented in various combinations. The disclosure may have additional parts that may be added to the embodiment. The disclosure encompasses omissions of parts and/or elements of the embodiments. The disclosure encompasses replacement or combination of parts and/or elements between one embodiment and another. The disclosed technical scope is not limited to the description of the embodiment. Several technical ranges disclosed are indicated by the description of the claims and should be understood to include all modifications within meaning and scope equivalent to the description of the claims.

The engine 16 to which the exhaust gas recirculation device 1 according to the above-described embodiment is applied may be either a gasoline engine or a diesel engine as long as it is a water-cooled type.

The heat insulating material forming the heat insulating layer for preventing the heat transfer from the exhaust gas heat exchanger 20 to the air is not limited to the above-mentioned heat insulation material such as foamed heat insulating material for continuous air bubble or glass wool. For example, a double-tube metal heat insulating container having a vacuum portion as a heat insulating layer on the wall surface may be used as the heat insulating material. The exhaust gas heat exchanger 20 is disposed in this heat insulating container. Thereby, it is possible to prevent heat radiation and heat transfer from the exhaust gas heat exchanger 20 to the external space of the heat insulating container. For example, a sheet-like heat insulating material made of resin and provided with a fine cellular air layer as a heat insulating layer on the wall surface may be used. By using such a heat insulating material, the space surrounding the exhaust gas heat exchanger 20 is insulated. This makes it possible to prevent the air located outside the exhaust heat exchanger 20 from taking away much heat from the exhaust gas heat exchanger 20 by natural convection. Therefore, in the exhaust gas heat exchanger 20, the heat of the engine cooling water can be efficiently transmitted to the EGR gas.

What is claimed is:

1. An exhaust gas recirculation system, comprising:

an exhaust recirculation pipe configured to recirculate an exhaust gas from the engine into an intake pipe of the engine;

an exhaust gas heat exchanger connected to the exhaust recirculation pipe and configured to perform a heat exchange between the exhaust gas and an engine cooling water used for cooling the engine;

a cooling water pipe configured to circulate the engine cooling water to the exhaust gas heat exchanger; and a heat insulating member forming a heat insulating layer on a heat transfer path from the exhaust gas heat exchanger to the outside, wherein the exhaust gas heat exchanger includes, a plurality of tubes through which the exhaust gas passes, a casing in which the tubes are housed, the casing including an inlet side flange and an outlet side flange, a cooling water flow path provided inside of the casing, through which the cooling water that exchanges heat with the exhaust gas flowing through the tubes passes, wherein the inlet side flange is configured to transfer heat to the casing and divide the exhaust gas to the plurality of tubes, and the outlet side flange is configured to transfer heat to the casing and collect the exhaust gas passed through the plurality of tubes, the exhaust recirculation pipe includes an upstream flange for connecting to the inlet side flange, and a downstream flange for connecting to the outlet side flange, the heat insulating member includes, an inlet side heat insulating member covers an inner peripheral edge and an outer peripheral edge of a connecting surface of the inlet side flange so as to have a heat insulating function and a sealing function, and an outlet side heat insulating member covers an inner peripheral edge and an outer peripheral edge of a connecting surface of the outlet side flange so as to have a heat insulating function and a sealing function.

2. The exhaust gas recirculation system according to claim 1, wherein the outlet side heat insulating member has higher thermal insulation performance than the inlet side heat insulating member.

3. The exhaust gas recirculation system according to claim 2, wherein a thickness of the outlet side heat insulating member is thicker than that of the inlet side heat insulating member.

4. An exhaust gas recirculation system, comprising:

an exhaust recirculation pipe configured to recirculate an exhaust gas from the engine into an intake pipe of the engine;

an exhaust gas heat exchanger connected to the exhaust recirculation pipe and configured to perform a heat exchange between the exhaust gas and an engine cooling water used for cooling the engine;

a cooling water pipe configured to circulate the engine cooling water to the exhaust gas heat exchanger; and a heat insulating member forming a heat insulating layer on a heat transfer path from the exhaust gas heat exchanger to the outside, wherein the exhaust gas heat exchanger includes, a plurality of tubes through which the exhaust gas passes, a casing in which the tubes are housed, the casing including an inlet side flange and an outlet side flange, a cooling water flow path provided inside of the casing, through which the cooling water that exchanges heat with the exhaust gas flowing through the tubes passes, wherein the inlet side flange is configured to transfer heat to the casing and divide the exhaust gas to the plurality of tubes, the outlet side flange is configured to transfer heat to the casing and collect the exhaust gas passed through the plurality of tubes, a water inlet pipe provided on the inlet flange side in the casing, and a water outlet pipe provided on the outlet flange side in the casing, the heat insulating member is a case heat insulating member configured to cover an outer periphery of the casing except for the water inlet pipe and the water outlet pipe.

5. The exhaust gas recirculation system according to claim 4, wherein the case heat insulating member continuously covers from the inlet side flange to the outlet side flange.

6. The exhaust gas recirculation system according to claim 5, wherein the casing includes an inlet surface where the water inlet pipe is provided, an outlet surface where the water outlet pipe is provided, and a top surface interposed between the inlet surface and the outlet surface, the case heat insulating member includes an inlet surface heat insulating member directly contacting the inlet surface, an outlet surface heat insulating member directly contacting the outlet surface, and a top surface heat insulating member directly contacting the top surface, and the inlet surface heat insulating member has higher thermal insulation performance than the outlet surface heat insulating member.

7. An exhaust gas recirculation system, comprising:

an exhaust recirculation pipe configured to recirculate an exhaust gas from the engine into an intake pipe of the engine;

an exhaust gas heat exchanger connected to the exhaust recirculation pipe and configured to perform a heat exchange between the exhaust gas and an engine cooling water used for cooling the engine;

a cooling water pipe configured to circulate the engine cooling water to the exhaust gas heat exchanger; and a heat insulating member forming a heat insulating layer on a heat transfer path from the exhaust gas heat exchanger to the outside, a cooling water temperature sensor configured to measure a temperature of the engine cooling water, a heat storage device provided in a downstream side of the cooling water temperature sensor, and being configured to perform heat storage and heat radiation by exchanging heat with the engine cooling water, a control device configured to control heating by the heat storage device based on the temperature of the engine cooling water measured by the cooling water temperature sensor, and a bypass pipe configured to circulate the engine cooling water not through the heat storage device by communicating the inlet pipe of the heat storage device and the outlet pipe thereof, wherein the control device performs a heat storage mode when the engine cooling water is lower than a predetermined temperature during the exhaust gas recirculation, the engine cooling water is heated by flowing the engine cooling water to the heat storage device, and when the engine cooling water is higher than the predetermined temperature, the engine cooling water flows through the bypass pipe so as not to pass through the heat storage device, and when the exhaust gas recirculation is not performed and the engine cooling water is higher than the predetermined temperature, heat is accumulated in the heat storage device by flowing the engine cooling water into the heat storage device.

8. The exhaust gas recirculation system according to claim 7, further comprising, a heat storage temperature sensor configured to measure the temperature of the heat storage device, and a valve configured to regulate the flow rate of the engine cooling water passing through the heat storage device, wherein the control device regulates the opening angle of the valve and to perform a heat radiation mode so as to circulate the engine cooling water through the heat storage device, when the temperature measured by the heat storage temperature sensor is higher than a heat radiation completion temperature at which heat radiation is completed.

9. The exhaust gas recirculation system according to claim 8, wherein, the control device regulates the opening angle of the valve and to perform the heat storage mode so as to circulate the engine cooling water through the heat storage device, when the temperature measured by the heat storage temperature sensor is higher than a heat storage start water temperature at which heat storage starts.

10. The exhaust gas recirculation system according to claim 9, wherein, the control device is configured so as not to circulate the engine cooling water to the heat storage device, when the temperature measured by the heat storage temperature sensor is lower than a heat radiation start water temperature at which heat radiation starts.

* * * * *